US005276987A

United States Patent [19]

Honse

[11] Patent Number: 5,276,987

[45] Date of Patent: Jan. 11, 1994

[54] SEQUENTIAL GRAPHIC DISPLAY SYSTEM

[75] Inventor: James J. Honse, Lake Oswego, Oreg.

[73] Assignee: Diamond Displays, Inc., Seattle, Wash.

[21] Appl. No.: 906,757

[22] Filed: Jun. 29, 1992

Related U.S. Application Data

[63] Continuation-in-part of Ser. No. 616,542, Nov. 21, 1990, abandoned.

[51] Int. Cl.[5] ..... G09F 11/30

[52] U.S. Cl. ..... 40/511; 40/509

[58] Field of Search ..... 40/509, 511, 524, 526, 40/359, 360, 124.2, 124.4

[56] References Cited

U.S. PATENT DOCUMENTS

| | | | |
|---|---|---|---|
| 422,570 | 3/1890 | Connett | 40/511 |
| 603,109 | 4/1898 | Lotz | 40/511 |
| 939,550 | 11/1909 | Rudolph | 40/511 |
| 2,493,530 | 1/1950 | De Saussure | 40/124.4 |
| 4,365,433 | 12/1982 | Buell | 40/124.2 X |

*Primary Examiner*—Kenneth J. Dorner
*Assistant Examiner*—J. Bonifanti
*Attorney, Agent, or Firm*—Robert L. Harrington

[57] ABSTRACT

A display system for two-dimensional displays wherein images are applied (e.g., photographically, printed or the like) to transparent sheets and transported through a viewing machine, the sheets being sequentially positioned in a back-lighted viewing window. The sheets are suspended from rods and stored behind the back-lighting area. The rods are arranged in a desired sequence in a storage rack having an entrance and exit. A chain is entrained on a circuitous pathway through the machine. The pathway starts at the exit end of the storage rack referred to as a pick-up station, then passes over the back-lighting area, extends downwardly between the back-lighted area and the window, passes under the back-lighting area and behind the stored display sheets to a return station that receives the sheets and directs them to the entrance to the storage rack, and then back to the pick-up station. The images are inverted on the sheets with the sheets suspended from the rods, e.g., in storage as they are inverted when positioned in the viewing window. As the sheets travel through the viewing window a guide channel lightly grips the sheets to keep the sheets taut for viewing.

12 Claims, 6 Drawing Sheets

SEQUENTIAL GRAPHIC DISPLAY SYSTEM

This is a continuation-in-part of application for U.S. patent Ser. No. 07/616,542 filed Nov. 21, 1990, now abandoned.

FIELD OF THE INVENTION

This invention relates to a graphic display system including a display machine and graphic carriers mounted in the machine, and more particularly to a system wherein the carriers are smoothly cycled in sequence through the machine and are readily removed and replaced as desired.

BACKGROUND OF THE INVENTION

Graphic displays as the term is used herein has reference to two-dimensional displays of all types and sizes which are intended to draw the attention of persons in the vicinity of the display, e.g., to influence decision making regarding products, events, etc. Such displays can be found in stores of every kind and description, (e.g., posters promoting products of the store), hotel lobbies, (e.g., back-lighted transparencies displaying facilities of the hotel), sporting events, (e.g., posters and transparencies advertising businesses of the community) and the like.

Whereas a shopper in a store will hardly be aware of the displays, it has been shown that such displays are noticed and purchasers are influenced by them. The competition for display space at the various locations is great and often the ability of a store owner to profit from the rental of display space is limited only by the space that is available.

It has also been shown that the type of graphic display makes a difference. For example, a back-lighted transparency gets more attention than a poster, and if the graphics of the display intermittently change, they get more attention than a stationary display. Displays that change by a visual rolling action capture more attention than instant display changes.

BRIEF DESCRIPTION OF THE INVENTION

The preferred embodiment of the present invention is directed to a system that includes a rolling display of back-lighted transparencies provided on individual carriers. Each carrier includes a support rod from which a transparency sheet depends. The rod projects past the width of the sheet to form guide tips. A connecting web between the transparency and the rod is configured to enable the guide tips and transparency sheet to be guided in separate but parallel guide paths.

The machine for displaying the carriers in the system includes a vertical queue rack that receives, holds and positions for pickup, a plurality of the rods. A pair of synchronized carrier chains (belts, cables or the like) located at the sides of the sheets and aligned with the guide tips of the rods are entrained along a guide path. Hooks carried by the carrier chain engage the guide tips of the bottom rod in the queue rack and guide the carrier over the back lighting station at the front of the machine and through a guide track separator which directs the rod along one path while the sheet is guided by side edge channels in close parallel relation.

The guide path takes the carrier downwardly in front of the back-lighted screen area with the side edge channels (or tensioners positioned in the channels) maintaining the sheet taut as it traverses downwardly through the screen area. When the sheet is positioned in the screen area, the carrier chain is momentarily stopped due to the rod end passing over a timer-relay switch which disables the power to the motor for a selectable preset time period. Further carriers are picked up in sequence by subsequent pairs of carrier chain hooks and each succeeding carrier overlaps with the trailing end of the preceding carrier to be moved into position for display as the preceding carrier is moved out of the screen area. The chain path for the preceding carrier then guides the carrier below and behind the back-lighting station and deposits the carrier rod in the top of the queue rack. The path of the chain then brings the hooks back around to the lower most rod in the queue rack and the process is repeated.

A major advantage is in the ability to change carriers (and thus the projected images of the carriers). The machine can be opened to expose the carriers in the queue rack. These can be simply lifted out, rearranged or replaced as desired and then reinserted in the queue rack. The machine has other advantages such as dependability, quiet operation and compactness. Features facilitating these advantages will be disclosed in detail in the following detailed description.

Prior Art

The only known sequential display device pertinent to the invention herein is described in Lotz, U.S. Pat. No. 603,109. Lotz has display sheets that depend from rods and the rods are guided along a pathway. However, the sheets are not captured in side edge channels to follow the rods as in the present invention. The display sheets of Lotz continue to depend from the rods throughout movement of the rods. This arrangement is incompatible with use of a back-lighting station and the overall dimensions of the display machine is substantially greater than a display machine for displaying comparably sized images of the present invention. The size of Lotz' machine in relationship to the image area of graphics would make Lotz commercially unfeasible in today's marketplace due to cost of advertising space versus revenue returned on size of image area.

DETAILED DESCRIPTION OF THE DRAWINGS

FIG. 1 is a schematic of the system of the invention;

FIG. 1*a* is a perspective view, also a schematic, illustrating a portion of the machine of the system of FIG. 1;

FIG. 1*b* is a perspective view of the graphics carrier as utilized in the system of FIG. 1;

DETAILED DESCRIPTION OF THE PREFERRED EMBODIMENT

Figure 1:
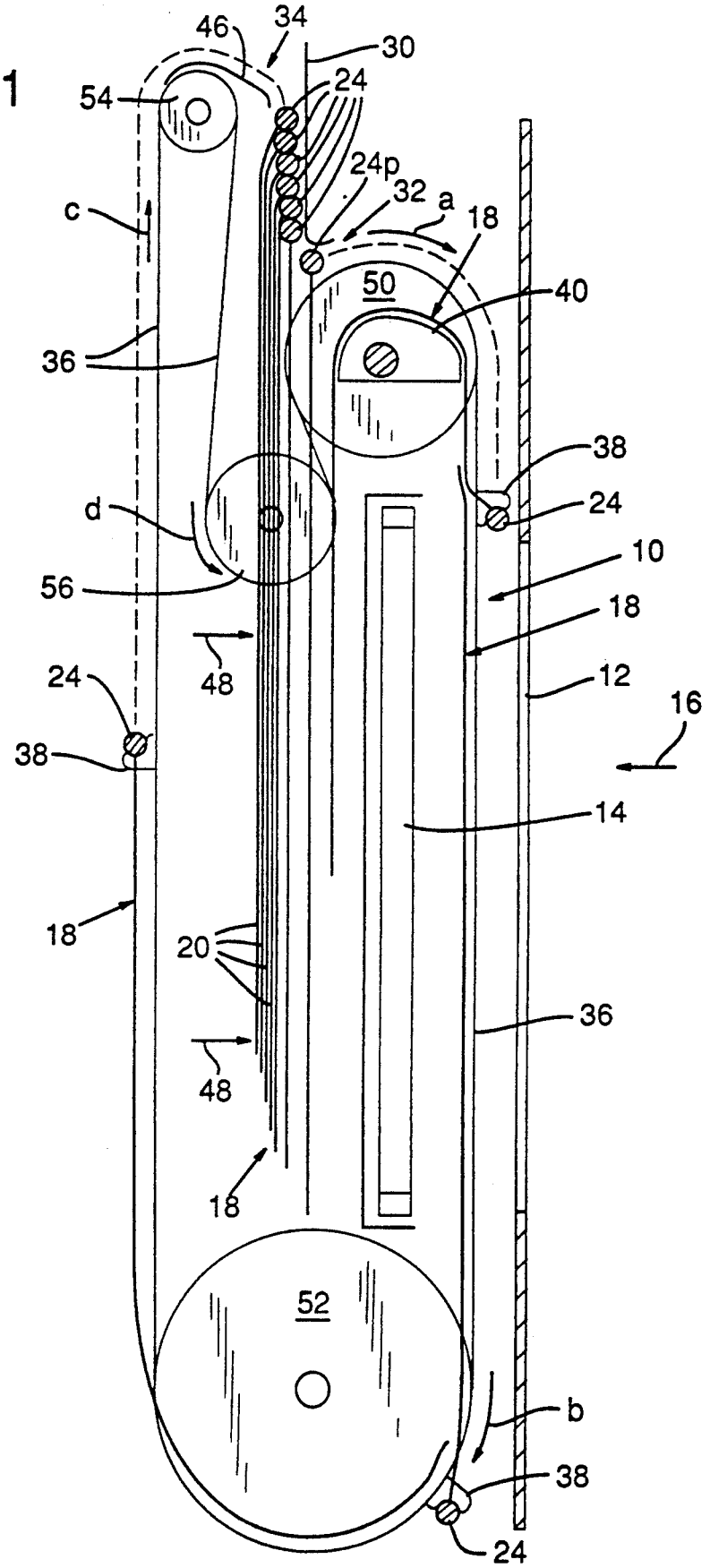

FIG. 1 is a schematic illustration which will be used to generally describe the operation of the system. It represents a side view of the system and as typical of back-lighted displays, a screen area 10 is provided between a viewing window 12 and a light source 14. As carriers 18 having sheets of image bearing transparencies are positioned in the screen area 10, light is projected through the transparencies and the images are viewed through the window 12 as indicated by arrow 16.

Figure 1A:
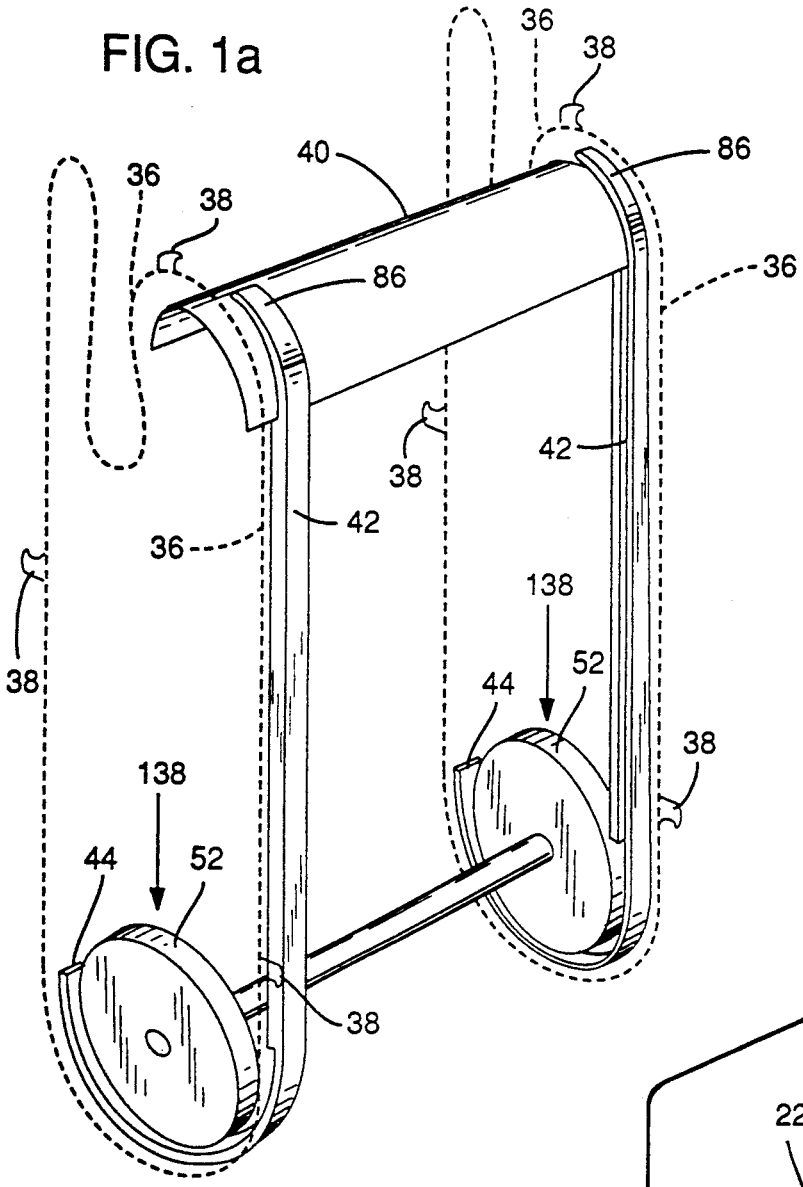
Figure 1B:
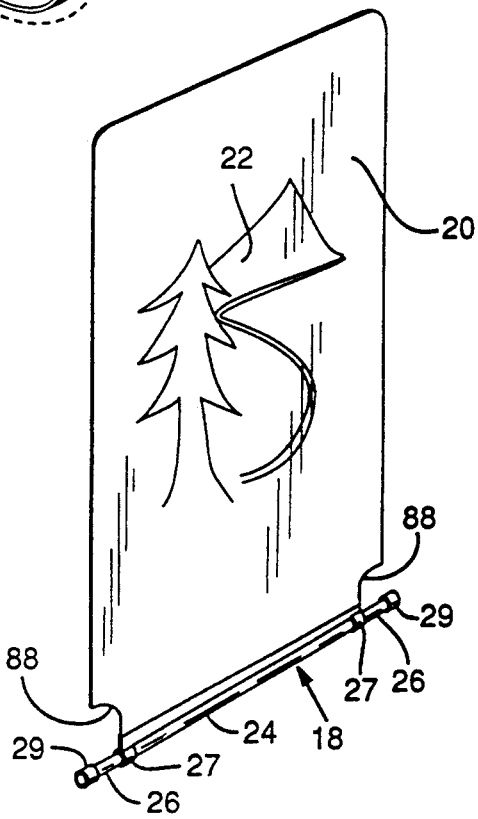

The present invention is directed in part to the sequential positioning and automatic recycling of the image bearing transparencies, an example of which is illustrated in FIG. 1*b*. The structure of FIG. 1*b* is referred to in total as a carrier 18 and includes a sheet 20 of a suitable transparency material on which an image 22 is imprinted, e.g., photographically. The sheet 20 is suspended from a carrier rod 24 (FIG. 1*b* illustrates carrier 18 as oriented when positioned in screen area 10, i.e., it is inverted). Rod 24 has ends that project past the width of the sheet 20 and are referred to herein a guide tips 26. A connecting web 28 connects one end of the sheet 20 to the rod 24.

Returning to FIG. 1, it will be noted that a plurality of the carriers 18 are stacked behind the light source 14 with the carrier rods 24 stacked one on top of the other in a queue rack 30 located above and behind the light source with the sheets 20 hanging downwardly therefrom. The sheet 20 depending from the uppermost rod 24 on the rack 30 is the rearmost sheet and the sheet depending from the bottommost rod in the rack is at the front (the intermediate sheets and rods being in order, i.e., back to front and top to bottom, respectively). The entire assembly is referred to generally as a carrier storage 29.

An endless carrier chain 36 is entrained on sprockets (50, 52, 54, 56) to define a carrier chain path (indicated by direction arrows a–d) that starts as indicated by arrow a at the position of the lowermost rod 24 in the queue rack 30 (referred to as a pick-up station 32), passes over the top of the light source 14 and then downwardly through the screen area 10. It exits the screen area below the light source 14 as indicated by arrow b and continues behind the carrier sheets 20 depending from the queue rack.

The pathway then extends upwardly to its uppermost position as indicated by arrow c which is sometimes referred to as a carrier return station 34 (to be explained in detail hereafter). This uppermost position is above the queue rack 30, the reason for which will become apparent. From the carrier return station 34, the chain path loops around sprocket 56 as indicated by arrow d to the start-up position at the pick-up station 32.

Referring also to FIG. 1*a*, a pair of elongated, endless transport members 36 (preferable a chain loop but which can be any one of a number of flexible lines, e.g., wire, cable, etc.) carries a series of paired hooks 38. As illustrated in FIG. 1, the lowermost carrier rod 24*p* is engaged by hooks 38, pulled out from under the rods in the queue rack 30 and transported along the above-described chain or transport path indicated by arrows a–c. It will be apparent by reference to FIG. 1*a* that the carrier chains 38 are spaced apart a distance greater then the width of the carrier sheet 20 and hooks 38 engage the carrier rod 24 at the guide tips 26 (see FIG. 1*b*). As the carrier rod is directed over the top of the light source 14, the carrier sheet of that rod trails along behind the rod as dictated by the guide surface 40. The side edges of the carrier sheet are directed into side edge channels 42 which hold the sheet taut in a vertical position as it travels downwardly into position in the screen area 10. When in position, a switch is tripped and the chain is stopped. The images of the sheet are viewed through the viewing window 12. When an adjustable preselected time has elapsed (e.g., three seconds), a timer resets the switch and the chain continues its movement and thus the carrier sheet 20 moves along the path headed toward the return station 34. In the appropriate sequence, subsequent carriers 18 are picked up by other pairs of hooks 38 and transferred to the screen area 10. As will be noted from FIG. 1, the leading edge of each subsequent carrier 18 overlaps the trailing end of the preceding carrier 18. This relationship continues throughout the cycling process.

As the carriers are transported upwardly behind the stored sheets in the queue rack 30, the side channels end (indicated as point 44 in FIG. 1*a*) below the bottom of the stored carrier sheets. Thus, as the carrier rod reaches the return station 34, the sheets 20 are hanging free below the rods. The rods are directed onto a return guide 46 at the return station 34 where the rods are released from the hooks 38. The rods are guided by return guide 46 to the top of the queue rack 30 and the freely hanging sheets simply slide laterally as indicated by arrows 48 into position against stored carrier sheets.

Detail of the various components will now be discussed in the following sequence: (a) the structure of the queue rack and pickup station, (b) the structure for guiding the carrier 18 through the screen area, (c) the structure of the carrier return station, (d) housing of the machine actuating mechanism reloading procedure, (e) operation.

(a) Queue Rack and Pick-up Station

Figure 2:
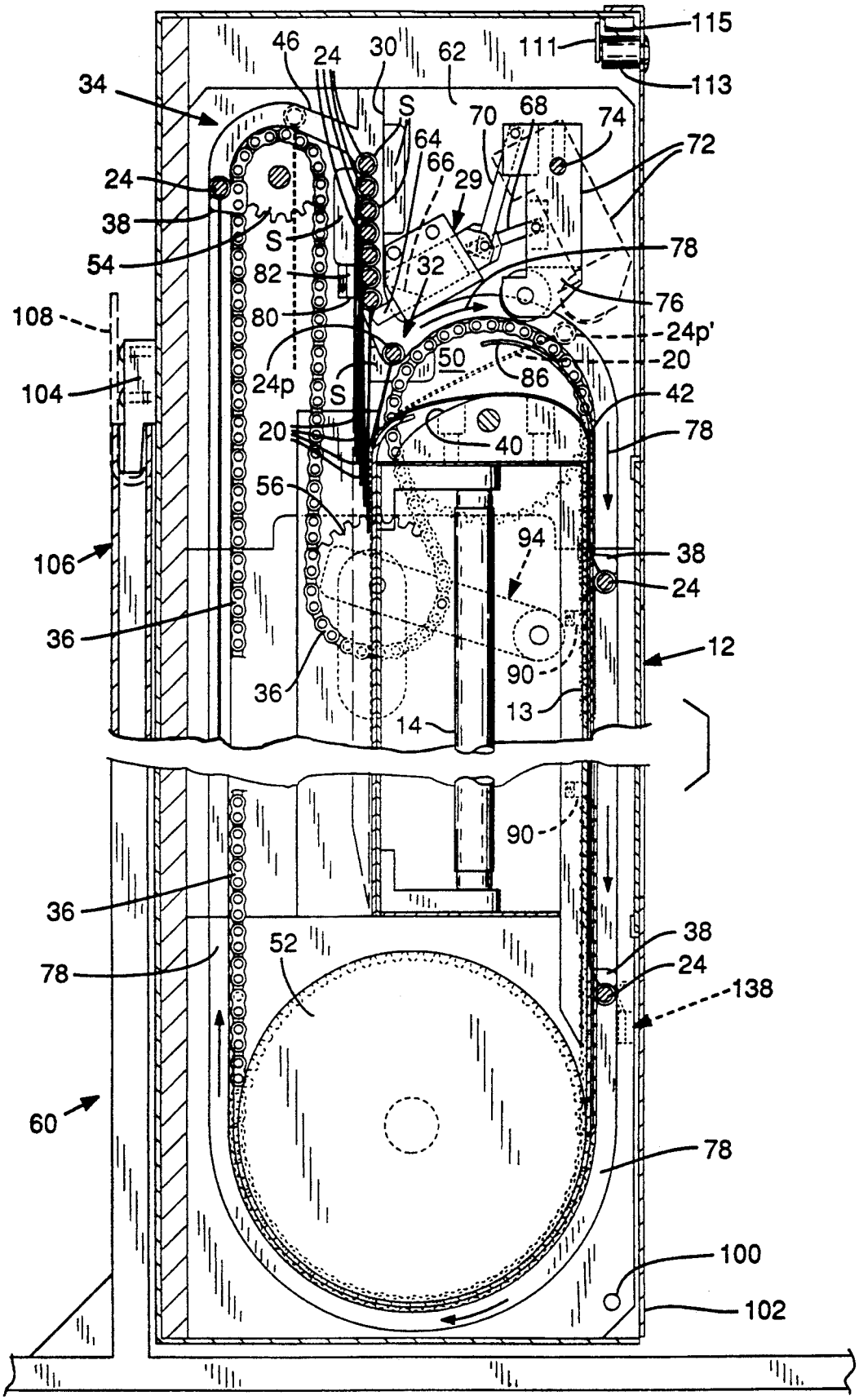
FIG. 2 is a sectional side view of the system of FIG. 1 illustrating in detail the structure of the machine and carrier transported through the machine.

The queue rack and pick-up station is most clearly disclosed in FIG. 2. The housing 60 has opposed side walls 62 with grooves formed in the side walls that confine the guide tips 26 of rods 24 and thereby provide the heretofore mentioned queue rack 30.

The pick-up station 32 includes first and second sliding protrusions 64, 66 having linkage arm 68, 70 respectively connected to a common cam 72. Cam 72 is pivoted at pivot 74 and includes an end 76 extended into the path 78 of the carriers. Thus following pick-up of carrier rod 24*p* the rod engages end 76 of cam 72 and pivots it forwardly about pivot 74 (see the dash line position). Arm linkage 70 is pushed rearward and linkage 68 is pulled forward. Protrusion 64 extends over the top of the next-in-line rod 24 and under the stack of succeeding rods 24 and protrusion 64 retracts to permit the "next-in-line" rod to drop into the pick-up station.

A number of features are added to the mechanism for improved performance. Sound deadening material is provided at each of the points indicated by the letter "S". Thus the machine operation operates silently to avoid distracting from the viewer's attention away from the screen area. The rod that is immediately above the "next-in-line" rod is located at a cavity 80 in the queue rack 30. A spring biased pad 82 in the cavity 80 urge this next succeeding rod 24 toward the upper protrusion 66. As protrusion 66 moves into the queue rack it pinches this rod 24 against the pad 82 which resistively retracts into the cavity 80. This prevents the rod from dropping but without the necessity of having to lift the rod and all the overlying rods in the queue rack, which would create a momentarily applied increased force on the endless carrier chain 36 and cause an unesthetically visual jerk or flutter to occur in the graphic image as it comes into the view area.

The arrangement of the linkage arm 68, 70 is also beneficial. Due to the angular position and length of the arms relative to the pivot 74, a more rapid insertion of protrusion 66 into the aligned rod 24 is achieved, i.e., before protrusion 64 releases the "next-in-line" rod. A spring return (not shown in FIG. 2 but shown and discussed in connection with FIG. 3) urges return of the cam 72 to the feed line position shown in FIG. 2 after the rod 24*p* has cleared the cam 72. In order to minimize depth of the display to make it commercially acceptable, the rods are queued in a vertical format. All but the rod stationed for pick-up should be kept separated from the pick-up rod or again, an unwanted force will be placed on carrier chain 36 at the time of pick-up.

(b) Guide for Carrier 18 into and through the Screen Area

Figure 2A:
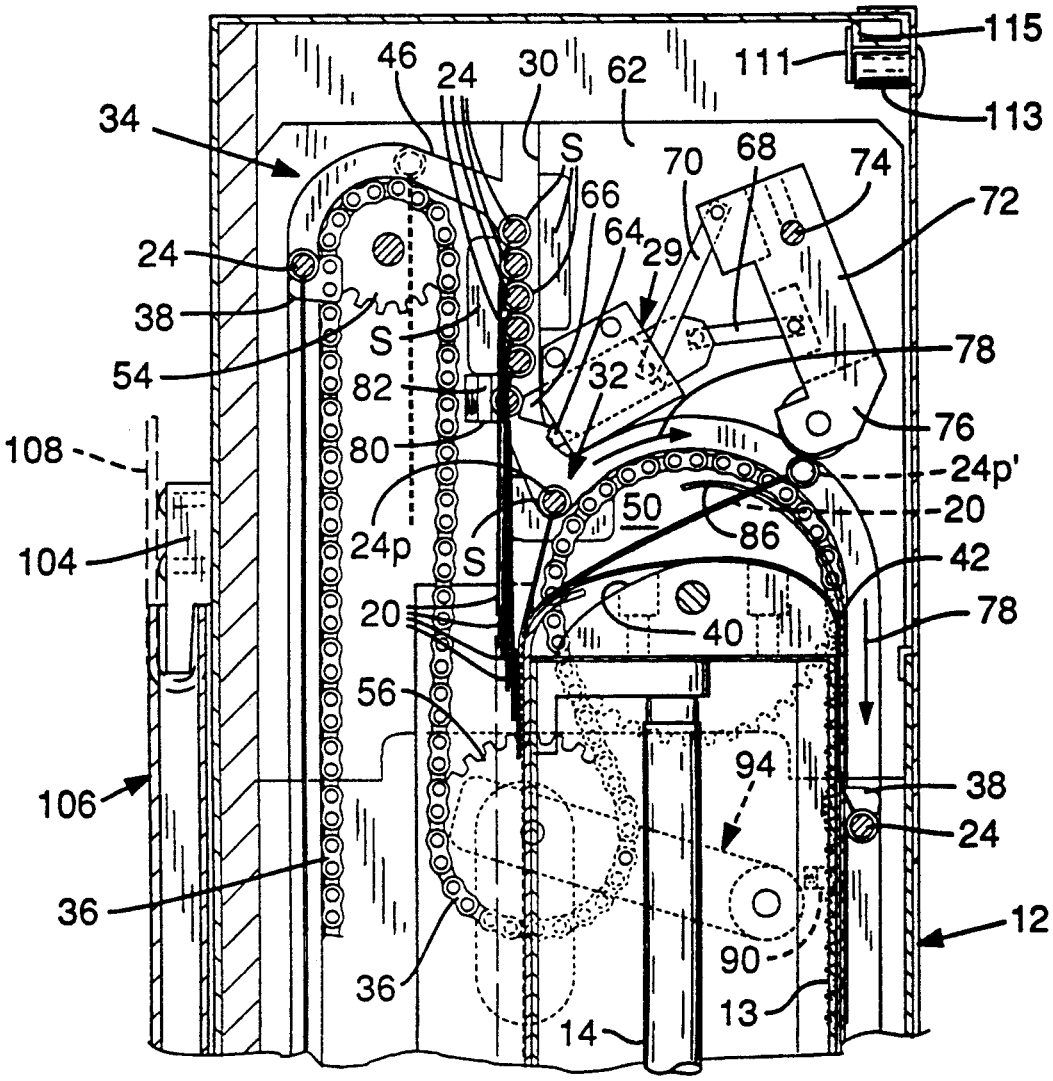

The Guide track for rods 24 and the side edge channels 42 can best be appreciated by comparing FIGS. 1*a* and 2. As can be seen from FIG. 2, as the carriers 18 traverse the screen area 10, the carrier rods are entrained along path 78 while the sheet 20 of carriers 18 are entrained in side edge channels 42. The close fitting channels 42 are desirable to keep the sheets 20 taut by means of a series of spring biased press buttons 90. The rods and sheets are guided into their respective channels by separator 86. As will be noted from FIG. 2*a*, as the rod 24*p* moves through the arched pathway over the light source station to the dash line position indicated as 24*p*', the sheet hangs downwardly until engaging guide surface or member 40. The orientation of the sheet and rod is such that the separator 86 projects into the notches 88 of the web 28, directing the rod over the separator and along the path 78 with the sheet directed into the channel 42.

Positioned along the side edge channels 42 are spring biased press buttons 90 for insuring that the sheets are maintained in a taut condition for viewing. A glass cover 13 covers the screen area and protects the transparency from contacting the lights.

(c) The Structure of the Carrier Return Station

The carrier return station 34 can also be seen in FIG. 2. As the rods 24 carried by the chain hooks 38 reach the upper most sprocket 54, the rods are transferred from the path 78 to a return guide channel 46. The hooks 38 are configured to cooperate with the return guide channel 46 to simply drop away from the rod 24 as the chain 36 loops over and down towards sprocket 56. The rod 24 moves along the channel 46 which directs the rod to the entrance end of queue rack 30. As will be apparent, the carrier chain is directed down under sprocket 56 and up over sprocket 50 where the hook 38 engage the rod 24 in the pick-up station 32 to start the process over.

The structure 94 shown in association with sprocket 56 provides for shifting of sprocket 56 to enable tightening of the chain 36 in a conventional manner and is not described in detail.

(d) The Housing of the Machine, Actuating Mechanism and Reloading Procedure

Figure 3:
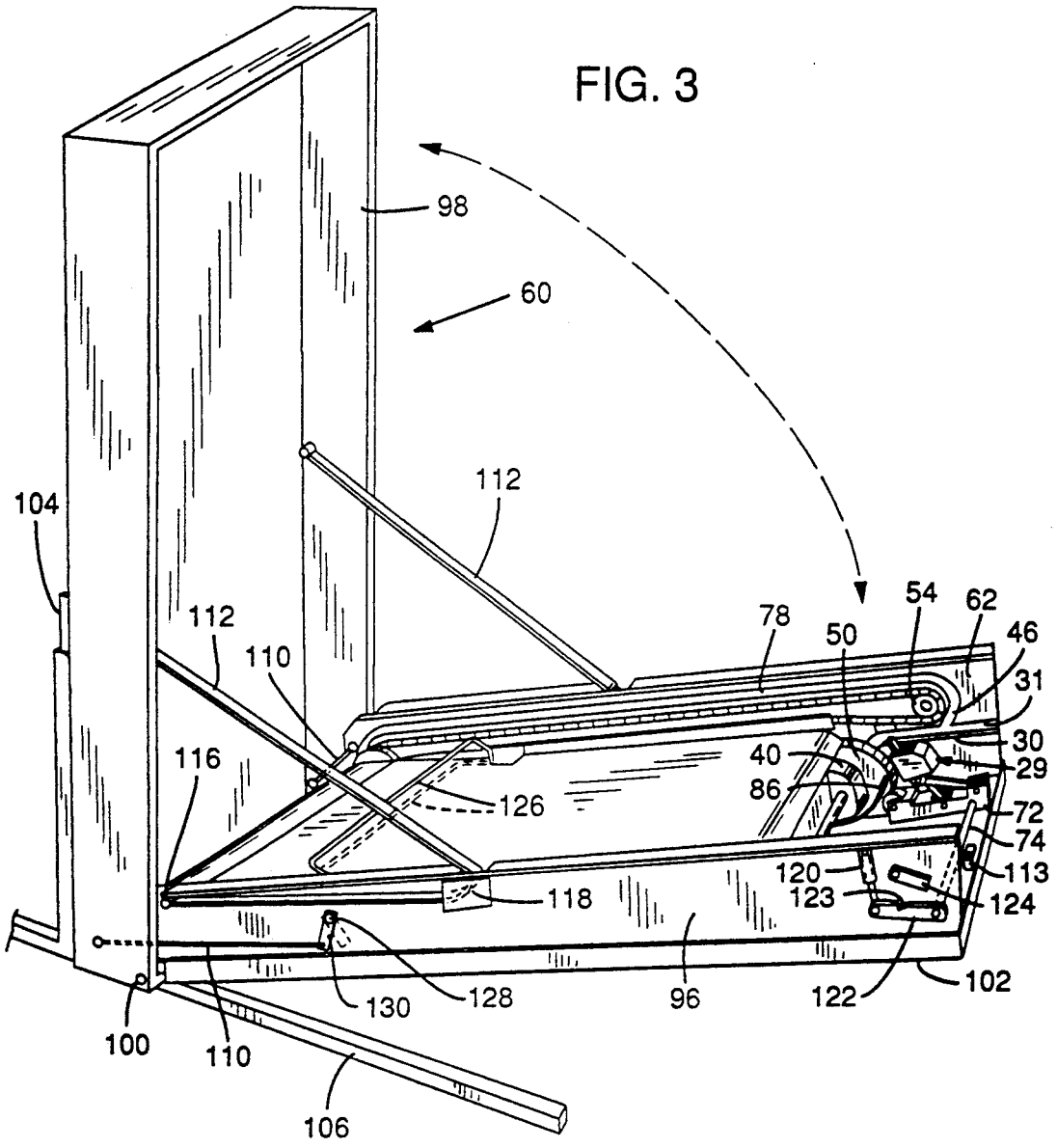
FIG. 3 illustrates the housing of the system in an open condition for loading and unloading.

As can best be seen in FIG. 3, the housing 60 is comprised of a main frame 96 that carries all of the components of the machine, a base frame 98 which pivotally supports the main frame at pivot 100, and a cover 102. From FIG. 2, it will be appreciated that the housing 60 can be mounted on free-standing stand 106. A clevis 104 secured to the back of the housing 60 is engaged by an upstanding pipe section of the stand 106. This same clevis can be used to mount the housing on a wall mounted bracket 108 illustrated in dash lines in FIG. 2. Alternatively, eyelet cutouts in the back of the display housing will also allow for a variety of pedestal feet or mounting capabilities.

With reference to FIG. 3, it will be noted that the main frame 96 has been tilted away from the upstanding base frame 98. A tether 110 limits the degree of opening. An elastic cord 112 is anchored at on end 114 to the base frame and at the other end 116 to the support frame and is slidably confined in a guide 118. The elastic cord acts as a spring to assist in opening and closing the unit.

Mounted to the outside of the main frame 96 is a lock-out mechanism that aids the user in unloading the graphics, i.e., the carriers 18. As previously explained, cam 72 is pivoted to the dash line position in FIG. 2 as the rods 24 engage the cam when carried over the top of the sprocket 50. From FIG. 3 it will be understood that pivot 74 protrudes to the outside of main frame 96 and forces pivoting of arm 122. From a comparison of FIGS. 2 and 3, with the cam in the retracted position, the stored rods 24 and the queue rack 30 (FIG. 2) are supported on plunger 66. When the rod 24 clears the path under cam 72, a spring 120 (shown in FIG. 3) forces return pivoting of arm 122 which resets the protrusions 64, 66. However, a lock-out arm 124 can be pivoted against return arm 122 (into notch 123) to prevent spring return thereof and this will prevent any further dropping of the carriers into the pick-up station. By continuing to cycle the carriers in the path along the path 78 through the system, all of the carriers can be returned to and gathered together in the queue rack 30.

From FIG. 3, it will be appreciated that in the opened position of FIG. 3, the carriers 18 contained in the queue rack 30 can be removed by sliding the rods through the open end 31 of the rack 30 and simply replaced as desired.

It will be appreciated that the sheets when free hanging as indicated in FIGS. 1 and 2 may not be hanging straight down. In particular, the rearmost sheet may become curled or flared outwardly at the lower end, and project rearwardly into the pathway of the carriers being transported along path 78. This is not a problem once the cycle has been started as each succeeding carrier overlaps a preceding carrier. At start-up, however, there is no overlap of the leading sheet with its predecessor which is the last carrier in the queue rack. In this situation only, as the start-up sheet is carried along the pathway behind the stored sheets, it can slide under this last sheet and create a problem. This problem is avoided with the use of a wire holder 126 shown in FIG. 3.

Referring to FIG. 3, all of the sheets in the queue rack are placed under the wire 126 in the opened position and upon closing, the wire is folded against the sheets to prevent the sheets from curling out over the path of the returning carriers. This wire holder 126 is spring biased against the sheets 120. The wire is pivoted at pivot 128 and is forced to its open position, i.e., to allow the reloading operation, as the main frame is opened, i.e., tether 110 forces pivoting of the pivot arm 130. When the main frame is closed, the tether 110 relaxes and the wire holder 126 folds against the sheets.

Wearing of the carrier sheets 20 can be a problem. This problem is minimized by providing all sliding surfaces, e.g., guide 40, with a low friction coating, e.g., Teflon (TM). As concerns that portion of the guide channel that goes under the sprocket 52, the sprocket provides a smooth moving inner rail for guide 42 and thereby avoids any sliding action. Any further problem with wearing is substantially eliminated by providing a clear plastic wear-resistant coating over the photographic front side of the sheet 20 and a transparent anti-static coating on the backside of the sheet. If sheet 20 is produced by non-photographic means, a clear plastic wear-resistant coating may not be required, due to use of abrasion resistant inks.

Referring further to the carriers as shown in FIG. 1*b*, because reduction of any noise is an objective, the rod ends are provided with a wear-resistant end cap 29, and sleeves 27 of sound deadening form are provided at the edges of the notches 88 as shown. The sleeves 27 aid in maintaining the carrier rods separated in the queue rack and facilitates the action of protrusions 64, 66.

Operation

Figure 4:
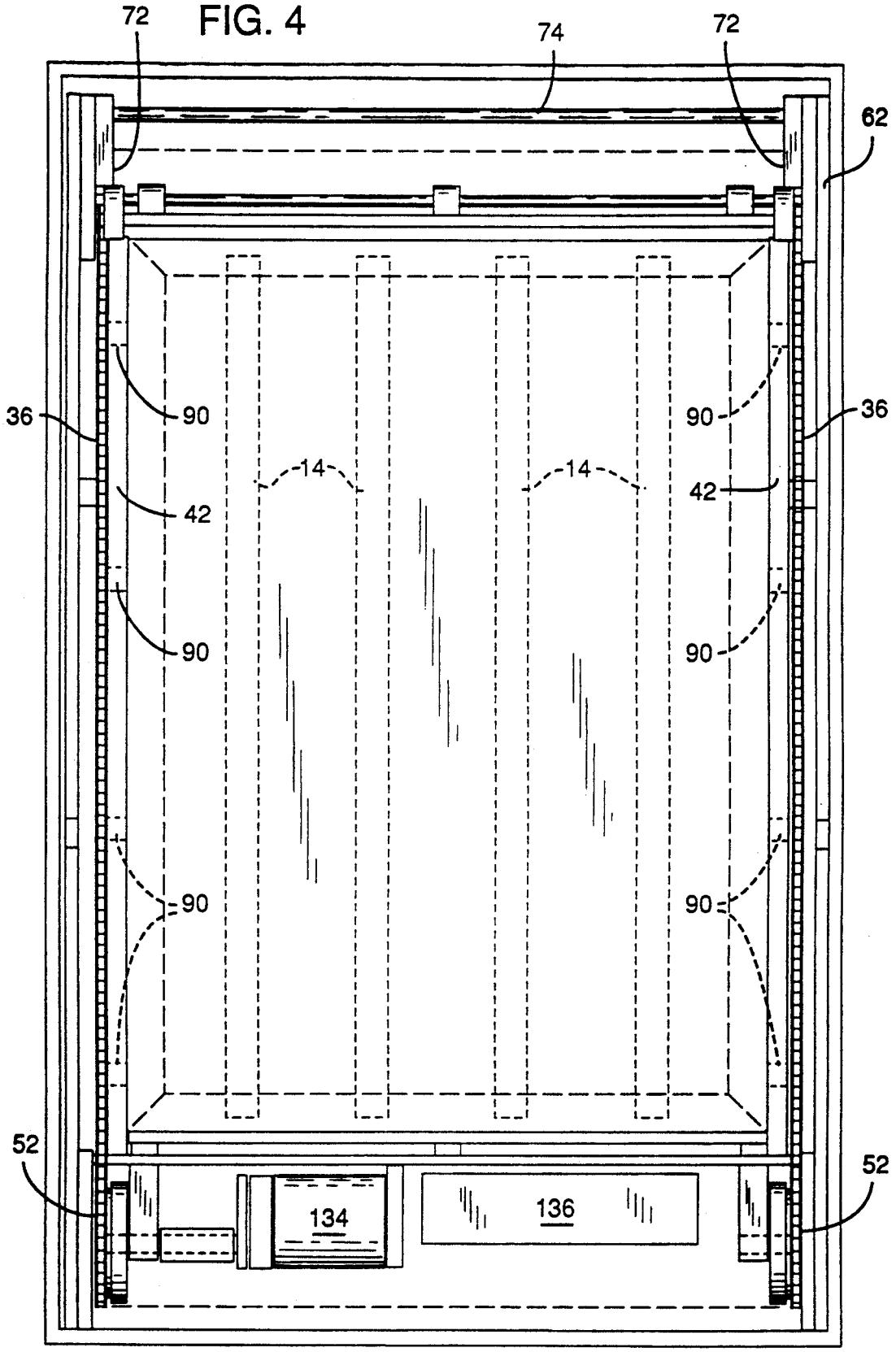
FIG. 4 is a front view of the machine with the front cover removed.

The operation of the system will be here repeated having reference to the detailed drawings of FIGS. 2–4.

From FIG. 2, note that the rods 24 of carriers 18 are stored in queue rack 30 and that a lowermost rod 24*p* is positioned at the pick-up station 32. A drive motor 134 shown in FIG. 4 (which is a front view of the machine with the cover 102 removed) is started, e.g., through engagement of a switch which is part of the electrical components 136 indicated also in FIG. 4. The drive motor 134 starts the chain 36 traveling through its defined pathway. A hook 38 picks up the carrier rod 24*p* from the pick-up station and carries it over the sprocket 50. As the rod 24*p* passes over separator 86 (see dash line position), separator 86 slides through the notches 88 in web 128 of the carrier 18, and the sheet 20 depending from rod 24*p* is guided over the guide surface 40 and under the separator 86. As the carrier continues along the pathway dictated by the chain path, the separator 86 and surface 40 converge to define a channel 42 that entraps and entrains the sheet 20 while rod 24 is retained in its adjacent, parallel channel 78.

As the rod passes over the sprocket 50, it engages cam end 76 and pivots cam 72 to actuate plungers 64, 66 to drop a next-in-line carrier rod onto the pick-up station. The next pair of hooks 38 of the carrier chain is spaced on the chain to pick up this next carrier rod just prior to the tail end of the trailing sheet 20 of the carrier rod 24*p*. As the sheet 24*p* traverses the screen area, it is held taut by pressure button 90 positioned along the channels 42. When the image of the sheet is positioned in the screen area, a switch 138 is tripped by the carrier rod 24*p* and the motor 124 is stopped. A timer (part of the electrical components 136) restarts the motor and the next-in-line carrier is positioned in the screen area. As the subsequent sheets are positioned and displayed, the prior carriers 18 are directed around the sprocket 52 and upwardly toward the return station 34. Upon completing the rounding of sprocket 52, the sheet edge guide channels 42 are discontinued and upon the carriers being returned along return guide 34 to the queue rack 30, the sheets simply slide laterally over against the stored sheets.

When the carriers are to be unloaded, the motor is switched off and the cover 102 which is secured to the main frame 96 is unlocked from the base frame 98, i.e., the tab of lock mechanism 113 is disengaged from lug 115 by turning, e.g., with a screw driver. The main frame 96 and cover 102 are pivoted away from base frame 98 about pivot 100. If one of the carriers in the queue rack are to be replaced, the job is a simple one. The carrier rods are removed and replacement is effected. If all of the carriers are to be removed, the lock-out 124 is engaged and the motor is switched on to return all of the carriers in the system to the queue rack.

Numerous variations are possible. Many of the features described herein are desirable but not necessarily a requirement. Examples are the sound deadening materials provided at the various positions indicated by the letter "s", the lock-out mechanism, the wire holder, the chain tightener, and the plunger and pad for the queue rack. The basic concept of the system in general which encompasses the machine and carriers, provides for the carriers to be cycled through a back-lighted display and yet provides the means for individual removal and replacement. Thus, the invention is not to be limited to the specific structure illustrated and described above but rather to the claims appended hereto.

I claim:

1. A system for sequentially displaying multiple images in a back-lighted screen area comprising:

a machine including a housing defining an enclosure having a front wall and side walls with a viewing window through the front wall, and multiple carriers each including a transparency sheet of flexible material having top, bottom and side edges depending from a rigid support member at the top edge thereof;

said machine comprising a light source positioned behind the viewing window and spaced therefrom to define a screen area, a queue rack positioned rearward of the light source, said queue rack having an entrance and an exit and an intermediate storage section for receiving, storing and dispensing in sequence the rigid support members of the carriers, and in the stored condition said carrier sheets freely hanging from the support members and positioned behind the light source, and said exit end of the queue rack defining a pick-up station;

an endless transfer member mounted in said housing, and mounting members for said endless transfer member defining a transport path that extends from the pick-up station over the light source and down through the screen area, under and behind the light source and the freely hanging carrier sheets in storage, then to an upper position at least the height of the entrance to the queue rack whereat a carrier return station is defined, and back to the pick-up station;

guide channels provided at the sides of the screen area for channeling the side edges of the transparency sheets of the carriers when transported through the screen area, hook members carried by said transfer member for engaging a rigid support member at said pick-up station and transporting the support member along said transport path and into the screen area, and a guide member overlying said light source guiding the trailing transparency sheet over the light source and into the guide channels to be guided downwardly through the screen area along a path that follows the rigid support member, a return guide at said carrier return station receiving said carriers, disengaging said carriers from the hooks of said transfer members, and directing said carriers to the entry of the queue rack while said hook of said transfer member continues along said path toward said pick-up station.

2. A system as defined in claim 1 wherein the queue rack supports the rigid support members in a substantially vertical position to be gravity fed to the pick-up station, and including a releasable holder holding the rigid support members of the carriers in the intermediate storage section of the queue rack and off the support member positioned for pick-up an actuator in the path of the transfer member, and a release member, said actuator responsive to engagement and transporting of the support member along the transport path for actuating the release member for release of the next-in-line support member to the pick-up station.

3. A system as defined in claim 2 wherein the release member is a pair of movable protrusions, one of said protrusions mounted for movement under the lowermost support member in the queue rack, and the other protrusion mounted for movement under the support member immediately thereabove, said protrusions alternately protruding under the respective support members, said actuator when actuated causing retractive movement of said one protrusion and engaging movement of the other protrusion to drop the lower-most support member only into the pick-up position.

4. A system as defined in claim 3 wherein the actuator is a pivotal cam arm projected into the path of the support member when transported by the endless transfer member, said pivotal arm connected to the pair of protrusions to force the alternate positioning thereof when the cam arm is pivoted by engagement of the support member, and biasing means to return the cam arm and the protrusions to the initial position with the remaining stored support members dropped from the other protrusions onto said one protrusion.

5. A system as defined in claim 3 wherein the queue rack is provided with a concavity on the side of the rack opposite the protrusions, and a biased pad at said concavity urging the support member toward said other protrusion whereby the protrusion and biased pad cooperatively hold the stacked support members separate from said lowermost support member as the latter is dropped onto the pick-up station.

6. A system as defined in claim 1, including a guide surface positioned over the light source for guiding the sheets of the carrier over the light source and into the side edges, and a press button associated with said side edges to inhibit sliding of the sheets through the side edges and thereby insure the sheets being held taut while positioned in the screen area.

7. A system as defined in claim 6 wherein the support member is a rod that extends past both sides of the sheets and forms guide tips, said guide tips guided by said hook members along a transport path adjacent and parallel to the side edges for the sheet, said carriers including a connecting web between said rod and said sheet and said connecting web having side notches, and a separator positioned in the path of the carriers which projects through the side slots of said web to direct the sheets, the side edges and the rods along said transport path.

8. A system as defined in claim 1 wherein the guide channels extend along the path of the endless transfer member and terminate at a position at least prior to a position on the upwardly returning portion of the transport path that is below the sheets of the carrier stored in the queue rack whereby as the rods thereof reach the carrier return station, the sheets thereof hang free of the guide channels, a return guide extended between said uppermost position of the guide path and the entry to the queue rack and cooperatively configured relative to the hook members to receive the support members and thereby disengage the support members from the hooks for guiding the support members to the queue rack entry with the freely hanging sheets being laterally moved in the free hanging condition into position behind the last sheet in the queue rack.

9. A system as defined in claim wherein the housing includes a support frame and a main frame pivotally supported on the support frame, said mounting members for said endless transport; queue rack, light source and viewing member are mounted on the main frame and when pivoted away from said support frame expose the carriers in the queue rack, said carriers thereby being readily available and replaceable.

10. A system as defined in claim 9 including a lock-out mechanism manually actuated to prevent the rigid support members from dropping to the pick-up station whereby the pathway can be emptied of the carriers by return of all carriers to the queue rack where they can be manually removed.

11. A system as defined in claim 10 wherein the carriers are transported in sequence with a subsequent carrier always overlapping the trailing end of a preceding carrier whereby the order of stacking in the queue rack cannot be upset as a result of a preceding carrier when freely hanging in the queue rack with its free hanging end curled into the path of the subsequent carrier except for the start-up carrier, said system including a holder that is spring biased against the sheets of the carriers stacked in the queue rack at start up to insure against a curled end of the last carrier sheet in the rack being extended into the return path of the start-up carrier.

12. A system as defined in claim 11 wherein a retractor is actuated to alternately retract and release the holder by pivotal opening and closing, respectively, of said main frame to insure awareness and convenient placement of a stack of carriers under the holder in a start-up situation.

* * * * *